US005988334A

United States Patent [19]

Caruso

[11] Patent Number: 5,988,334

[45] Date of Patent: Nov. 23, 1999

[54] WHEELED BRIEFCASE

[76] Inventor: Edna Caruso, 247 Wells Rd., Palm Beach, Fla. 33480

[21] Appl. No.: 09/019,078

[22] Filed: Feb. 5, 1998

[51] Int. Cl.[6] ..... A45C 5/14; A45C 13/22; A45C 13/28; A45C 13/30

[52] U.S. Cl. ..... 190/18 A; 190/39; 190/102; 190/114; 190/115

[58] Field of Search ..... 190/18 A, 102, 190/114, 115, 39

[56] References Cited

U.S. PATENT DOCUMENTS

| | | | |
|---|---|---|---|
| 672,173 | 4/1901 | Le Fevre | 190/102 |
| 2,581,417 | 1/1952 | Jones | 190/18 A X |
| 3,169,615 | 2/1965 | Stein | 190/114 |
| 3,744,601 | 7/1973 | Doppelt | 190/114 |
| 4,759,431 | 7/1988 | King et al. | 190/18 A |
| 5,108,119 | 4/1992 | Huang | 190/18 A X |
| 5,253,739 | 10/1993 | King | 190/18 A |
| 5,323,886 | 6/1994 | Chen | 190/18 A |
| 5,368,143 | 11/1994 | Pond et al. | 190/18 A |
| 5,377,795 | 1/1995 | Berman | 190/18 A |
| 5,385,220 | 1/1995 | Pond et al. | 190/18 A |
| 5,431,428 | 7/1995 | Marchwiak et al. | 190/18 A X |
| 5,435,423 | 7/1995 | Rekuc et al. | 190/114 X |
| 5,488,756 | 2/1996 | Hsieh | 190/18 A X |
| 5,555,960 | 9/1996 | Bartsch | 190/18 A X |
| 5,560,458 | 10/1996 | Franklin et al. | 190/102 X |
| 5,593,009 | 1/1997 | King | 190/102 |
| 5,762,169 | 6/1998 | Deliman et al. | 190/18 A X |
| 5,762,170 | 6/1998 | Shyr et al. | 190/114 X |

*Primary Examiner*—Sue A. Weaver
*Attorney, Agent, or Firm*—McHale & Slavin, PA

[57] ABSTRACT

A wheeled briefcase has a container and a two-piece lid assimilating the appearance of a conventional court briefcase. The wheeled briefcase includes a pair of wheels placed along the rear of the case, spaced apart to provide stable maneuvering. An integrated telescoping handle construction cooperates with the included wheels to facilitate rolling transportation of the case. A retractable strap may be used to secure additional cargo placed on top of the briefcase.

5 Claims, 5 Drawing Sheets

WHEELED BRIEFCASE

FIELD OF THE INVENTION

This invention relates to an improved briefcase and, in particular, to a briefcase for use in the legal profession having integrated wheels, a telescoping handle, and an optional retractable case attachment strap.

BACKGROUND OF THE INVENTION

The use of wheeled carts for moving heavy or oversized items is well known in the art. Depending on the item to be moved, a portion of the wheeled cart may be integrated into the item. For instance, most modern suitcases are manufactured with integrated wheels which allow the suitcase to moved with minimal or reduced lifting. A number of patents have issued which are related to this area.

U.S. Pat. No. 4,759,431 discloses a rolling travel bag with a combination pull handle and an auxiliary bag strap that may be extended from the handle portion. The bag includes an elongated strap preferably of an inelastic webbing material which can be utilized to attach an auxiliary piece of luggage to the travel bag. The strap is mounted in the handle unit, so that it can be extended therefrom, but can also be retracted into a stored position when not in use. An elastic cord is utilized to bias the strap into its stored or retracted position.

U.S. Pat. No. 5,253,739 discloses a wheeled flight bag having a retractable pull handle. The bag is formed around and supported by an internal frame. The handle is integrated into the internal frame. The frame includes wheels for rolling transport.

U.S. Pat. No. 5,323,886 discloses a suitcase having a retractable handle assembly that is detachable from the case. The handle assembly includes a hollow base frame having wheels and a tie strap to secure additional baggage to the outside of the suitcase.

U.S. Pat. No. 5,368,143 discloses a wheeled suitcase having a pivotable wheel and handle assembly. The wheeled case includes a handle and a pivot rod retained in a transverse channel formed in the lid of the case. The pivot rod is rotatable about its axis within the channel, permitting movement of the handle from a raised position to a lowered position.

U.S. Pat. No. 5,377,795 is directed to a two-way towable luggage device which may be rolled alternately on four or two wheels. Additional pieces of luggage may be secured with an included bracket, when the cart is tipped onto two wheels.

U.S. Pat. No. 5,385,220 discloses a carry-on case having a telescoping handle The telescoping handle folds over the side of the case to form a dolly or along the length of the case if used as a single carry-on case.

U.S. Pat. No. 5,435,423 discloses a catalog case with a molded body. An included handle may be attached in one of two orientations.

U.S. Pat. No. 5,593,009 discloses a luggage attachment system for securing a secondary case to the exterior of a primary case. The system includes an attachment strap; the strap is folded into a storage pocket when not in use.

Despite the numerous items patented for the assistance of travelers, what is lacking in the art is a carrying device that accommodates lawyers. In particular, a court briefcase is typically used by an attorney to carry documents on a daily basis. The attorney may use the briefcase to carry client files, trial briefs, case books, and other materials to remote locations. Court briefcases are designed to maximize storage capacity and, once filled, are often bulky and difficult to carry. Should an attorney carry multiple briefcases, the accumulated weight can produce undue muscle strain on any individual.

One alternative to carrying a court briefcase is to place such an item on a wheeled cart. A wheeled cart, also know as a dolly, must be sized properly to carry such a briefcase and provide proper securement to prevent damage to the case. Proper securement typically consists of tie-down members such as elastic cords. Elastic cords requires that they be properly adjusted to prevent cord detachment, load slippage, abrasion, chafing, or structural damage to the briefcase.

Wheeled carts, because of their construction, also present a concern when passing through metal detectors such as those used in courthouse entrances. In many instances the court briefcase must be removed from the cart for visual inspection, subjecting the case to possible damage during removal and replacement. Most court briefcases are fragile containers having leather-clad walls which can easily be damaged if not handled properly.

Should an attorney need to carry multiple cases, the use of the cart becomes invaluable. However, proper securement becomes an additional problem if the elastic cords were chosen for a specific sized item. Still another problem is the stability of the cart which positions the wheels close to each other. Should a court briefcase be placed on top of another court briefcase, the need for securement extends to both cases making the elastic cord placement critical.

Thus, what is lacking is the art is a court briefcase specifically designed for attorneys that allows for a stable transport of one or more briefcases while maintaining the professional appearance of the court briefcase.

SUMMARY OF THE INVENTION

The instant invention is a court briefcase having integrated wheels, a lid-mounted handle, and an extendable baggage-securement strap. The outside of the briefcase maintains the appearance of a conventional, box-type court briefcase. Support wheels are mounted along a bottom edge of the case, near opposing sidewalls. This wide-track wheel placement provides maximum case stability. As a result, the briefcase is stable and easily rolled, even when fully loaded with documents.

The case includes an integrated telescoping handle construction. When extended, the handle is used for tilting the case causing the wheels to engage the ground. The rear wall of the case is formed from a rigid material such as plastic, fiberglass, or fiber board so as to provide minimal intrusion into the cavity yet prevent items placed into the cavity from interfering with the handle operation.

Flexible baggage-securing straps are provided on reels. The reels are spring biased and allow slack-free adjustment of the strap length. As a result, the straps may be passed around additional items placed on top of the briefcase. Each strap includes a hook that engages the telescoping handle to secure additional baggage placed upon the closed briefcase.

Thus, an object of the instant invention is to disclose a wheeled court briefcase having particular application for attorneys. The briefcase assimilates a conventional court briefcase, while providing the convenience of wheels and a telescoping handle.

Another object of the instant invention is to disclose a wheeled briefcase having an integrated flexible strap that allows securement of items stacked upon the case, without the need for independent securement straps.

Another object of the instant invention is to disclose a wheeled briefcase having a top surface shaped to accommodate the placement of additional items thereon, including a similarly shaped case when stacked vertically.

Still another object of the instant invention is to disclose a wheeled briefcase having an internal casement for protection of wheels and the telescoping handle.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1A:
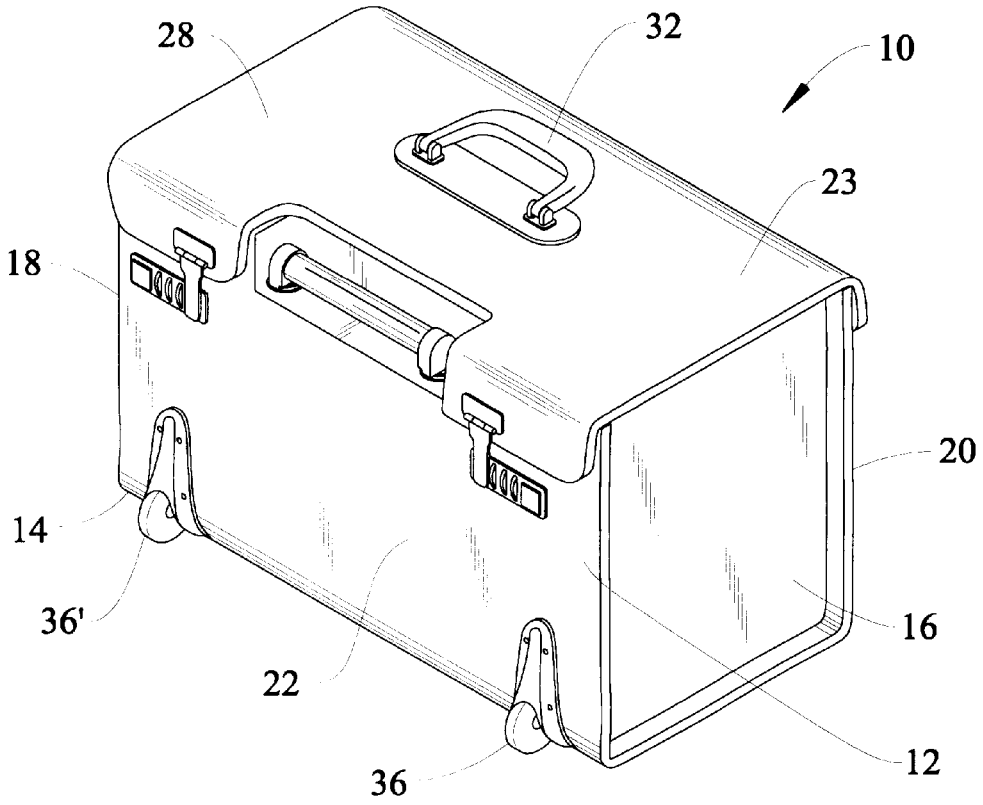
FIG. 1*a* is a perspective view of the briefcase of the present invention.
Figure 1B:
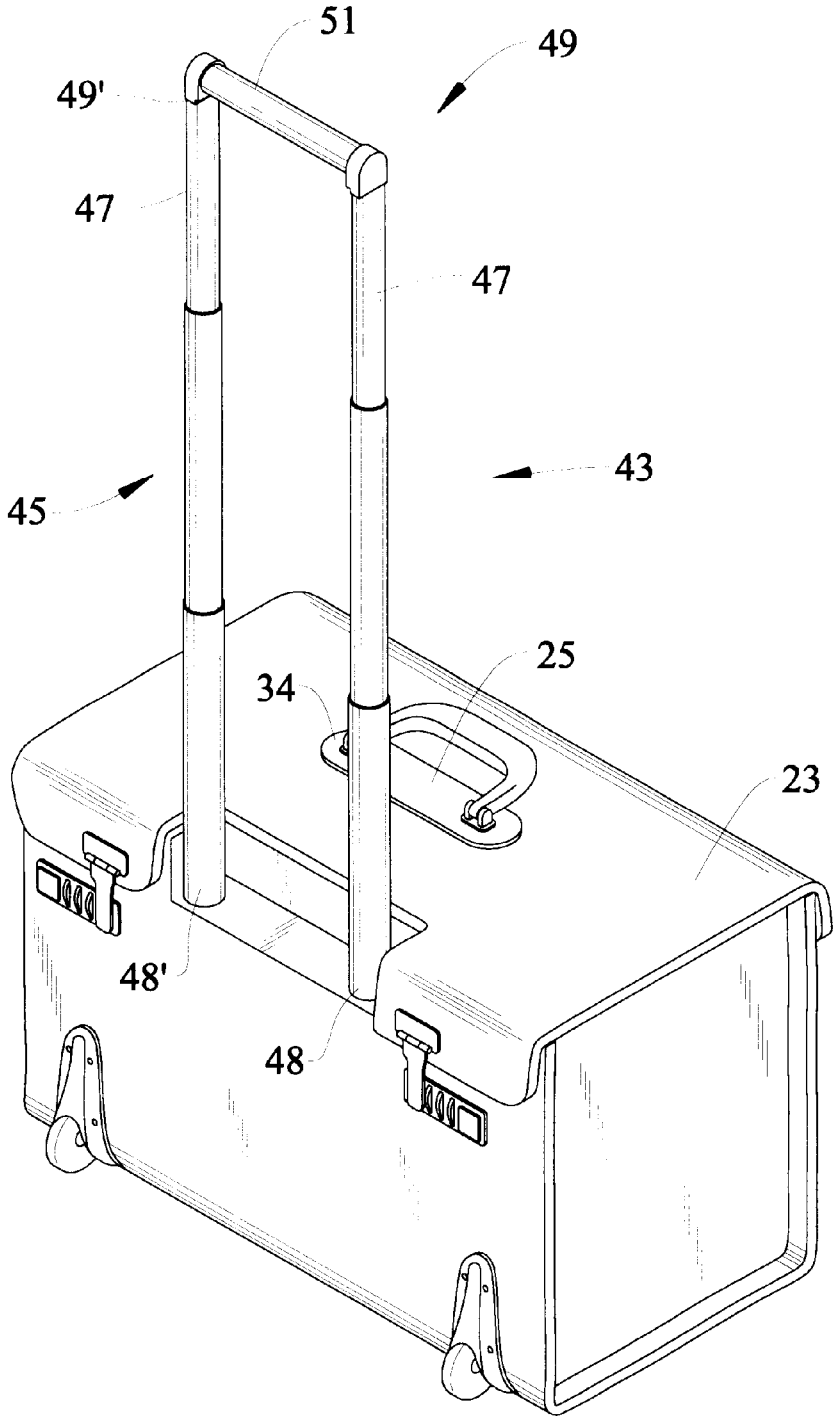
FIG. 1*b* is a perspective view of the briefcase shown in FIG. 1*a,* having a telescoping handle construction placed in an extended orientation.
Figure 2:
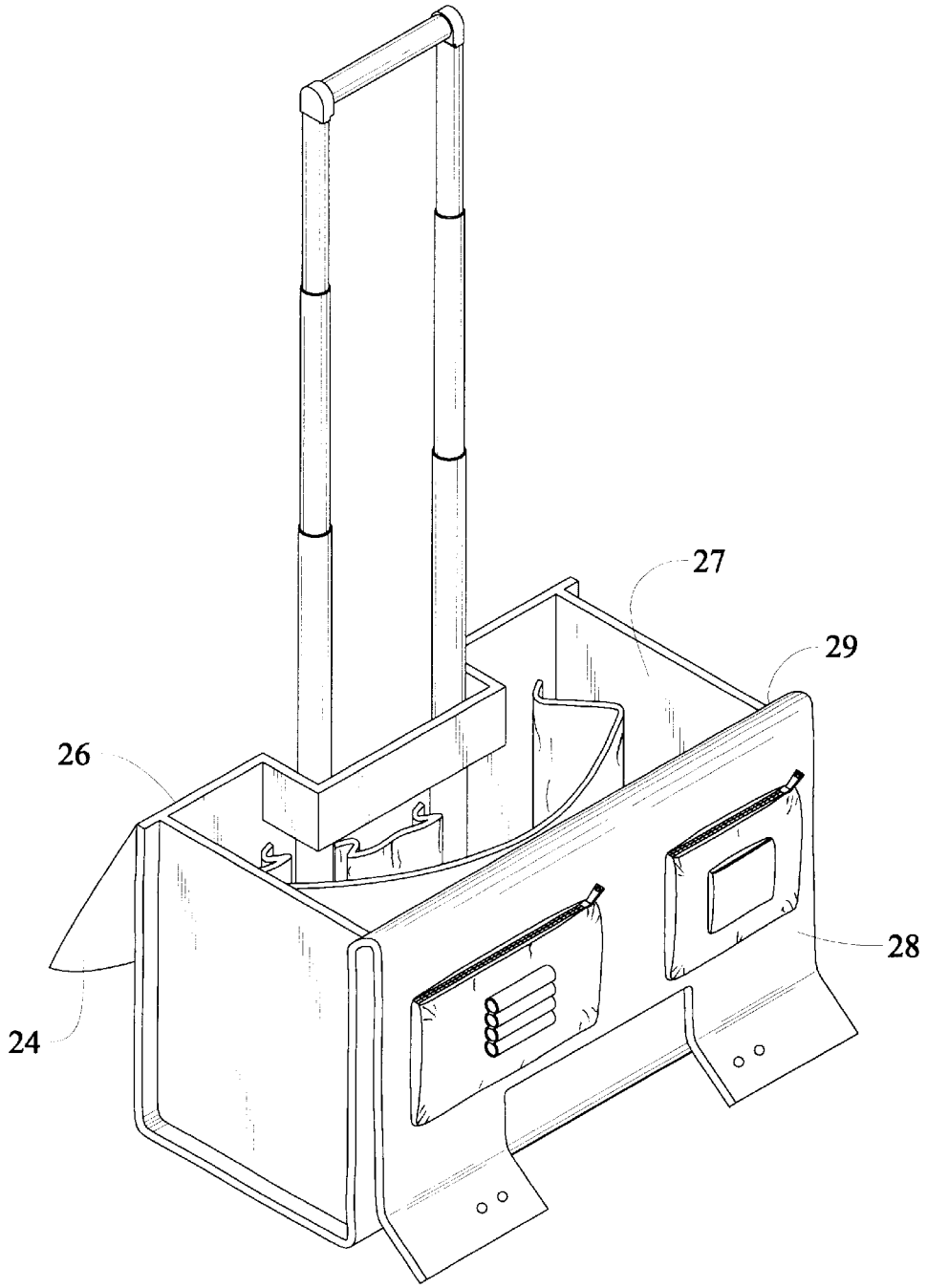
FIG. 2 is a perspective view of the briefcase shown in FIG. 1*b,* having a lid folded into an open position.

Now referring to FIG. 1*a,* 1*b,* and 2 set forth is the wheeled briefcase 10 of the instant invention consisting of a container 12 formed from a bottom wall 14, a first side wall 16, a second side wall 18, a front wall 20, and a rear wall 22. A two-piece lid 23 selectively covers the interior 27 of the container 12. The lid 23 includes a pair of overlapping panels 24,28 connected to the top of the container 12. More particularly, the first panel 24 is hingedly connected to a top edge 26 of the container rear wall 22, and the second panel 28 is hingedly connected to a top edge 29 of the container front wall 20. A grasping handle 32 extends from an upper surface 25 of said first panel 24 and is hingedly attached thereto. A centrally-located grasping handle aperture 34 perforates the second panel 28 and provides a passageway through which the grasping handle 32 may pass when the first and second panels 24,28 are folded into an overlapping, closed orientation. Since the handle aperture 34 is sized to allow the grasping handle 32 to pass therethrough, the panels 24,28 lay flat when overlapped.

A pair of wheels 36,36' attached to the container 12 provide rolling support for the briefcase 10. In keeping with the objects of the present invention, the wheels 36,36' are partially hidden, extending outward past the rear wall 22 enough to support the container 12 in a tipped orientation. As a result, the container 12 rolls easily when tipped for travel, yet remains stable when stood upright on the bottom wall 14. The wheels 36,36' are preferably placed at opposite edges of the rear wall 22 to provide maximum stability during travel.

Figure 3:
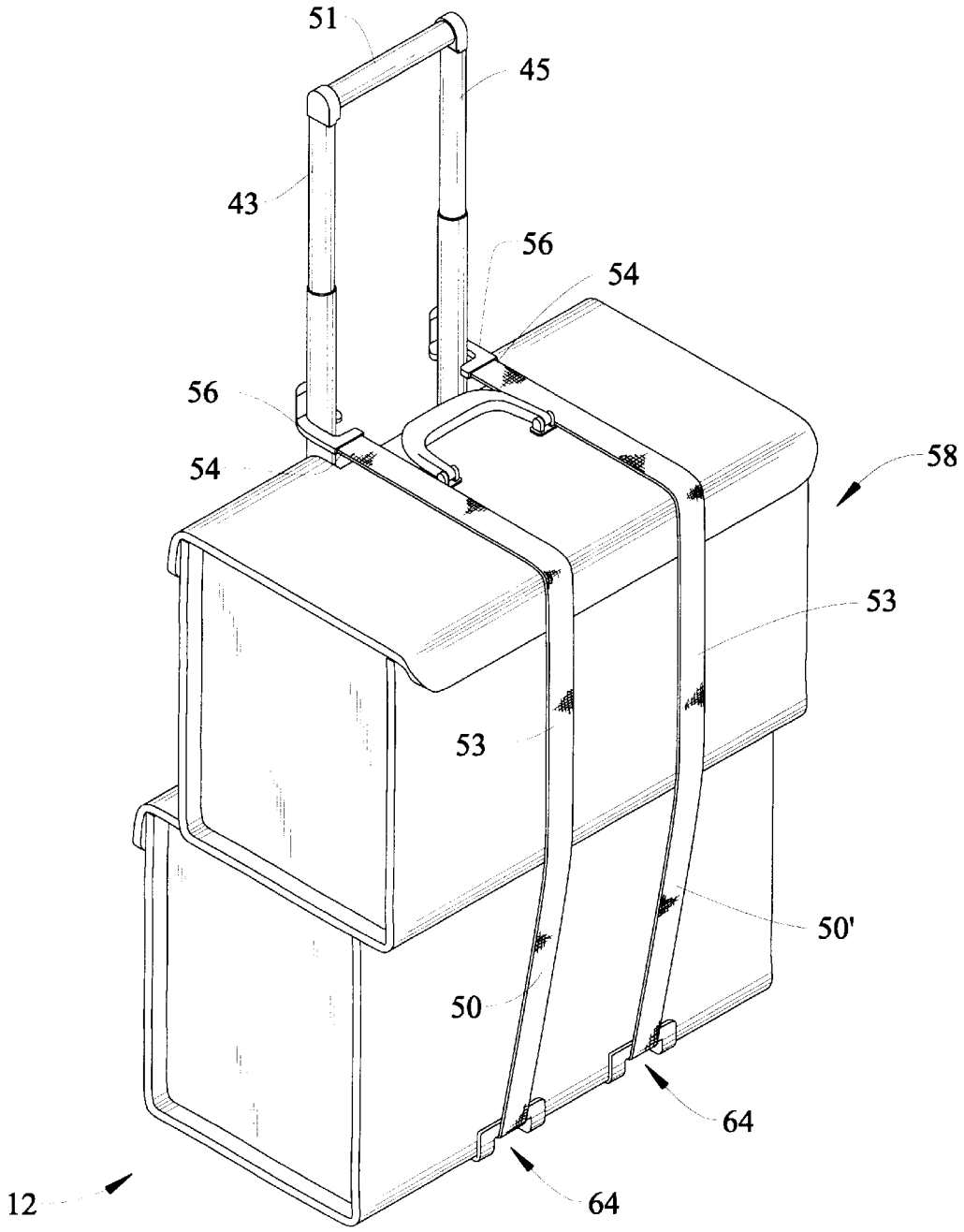
FIG. 3 is a perspective view of the briefcase shown in FIG. 1*b,* including an additional cargo secured for travel.

A telescoping handle construction 40 is formed integral with the container rear wall 22. The handle construction 40 includes a pair of telescoping rods 43,45. Each telescoping rod 43,45 actually includes several segments 47 nested to extend or retract as desired. In a preferred embodiment, the segments 47 are tubular and each rod 43,45 includes three such nested segments. Each rod 43,45 includes a first end 48,48' secured within the container rear wall 22. Each rod 43,45 is further characterized by a second end 49,49' located opposite the first end 48,48'. A rigid control bar 51 extends between rod second ends 49,49' and allows the rods 43,45 to be extended or retracted in unison. The handle construction may include spring-loaded pins, not shown, that selectively engage detentes located within the rods 43,45. The pin-and-detente design maintains the rods 43,45 in a user-selected position, allowing the rods 43,45 to be extended for travel or retracted for storage, as needed. As shown in FIG. 3, when the rods 43,45 are extended, the handle construction 40 acts as a support brace, preventing unsecured movement of items placed on top of the closed container 23.

Figure 4:
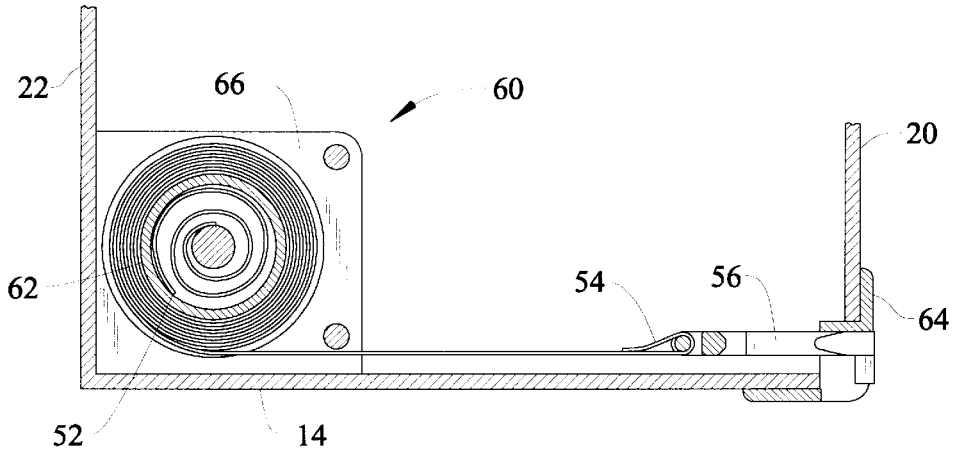
FIG. 4 is a cross-sectional side view illustrating the strap positioning means of the briefcase of the present invention.

With continued reference to FIG. 3, the wheeled briefcase 10 includes integrated flexible straps 50,50' that cooperate with the telescoping rods 43,45 to secure items, such as other boxes 58, onto the top of the container 12. Each strap 50,50' includes a proximal end 52 spaced apart from a distal end 54 by a middle portion 53. Each distal end 54 includes a hook 56 shaped to engage one of the telescoping rods 43,45. Each proximal end 52 is attached to a strap positioning means 60 that provides slack-free adjustment of the effective length of the straps 50,50'. The strap positioning means 60 includes a cylindrical take-up reel 62 rotatably mounted inside a reel housing 66. The reel housing 66 is disposed within the container 12. As shown in FIG. 4, middle portion 53 of each strap 50,50' is wrapped around the reel 62. The reel 62 is coil-spring-biased to urge the straps 50,50' into a retracted position.

Figure 5:
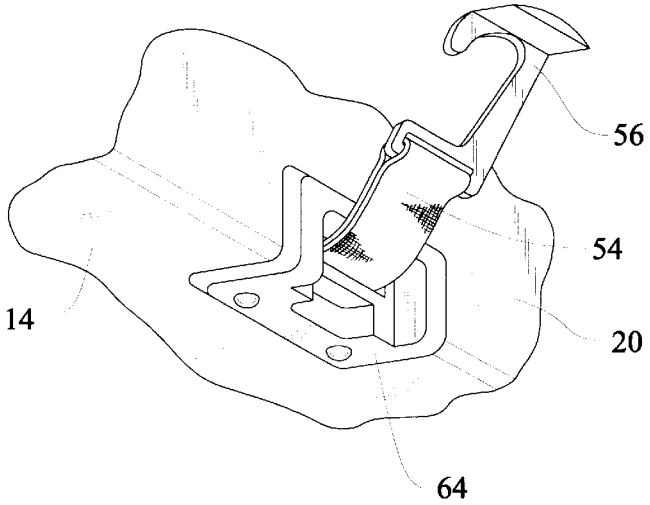
FIG. 5 is a close-up view of the strap guide and strap hook of the briefcase of the present invention.

In the retracted position, each hook 56 is advantageously concealed within a strap guide 64 located at the bottom of the container front wall 20. As shown in FIG. 5, when the straps 50,50' are drawn into an extended position, the hooks 56 and strap distal ends 54 pass through a corresponding strap guide 64. When a suitable amount of strap 50,50' has been unwound off the reel 62, the strap middle portion 53 is placed against the additional cargo 58 and the hook is secured to a corresponding rod 43,45. Because the reel 62 is spring biased, unnecessarily withdrawn strap material is automatically rewound onto the reel. In this manner, the strap positioning means 60 automatically adjusts, the strap length to compress the extra cargo 58 against the telescoping rods 43,45 and the container lid 23. When both straps 50,50' have been extended appropriately and secured to the corresponding rod 43,45, the container 12 and additional cargo 58 may be tipped and rolled easily to a desired location.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A wheeled briefcase comprising: a container having an interior formed by a front wall spaced apart from a rear wall by a first side wall, a second side wall, and a bottom wall;

a two-piece lid sized and positioned to selectively cover said interior, said lid including a first panel hingedly secured to an upper edge of said front wall and a second panel hingedly secured to an upper edge of said rear wall, said first panel sized to overlap said second panel when said panels are folded into a closed orientation;

a handle aperture disposed in said second panel;

a grasping handle hingedly secured to an upper surface of said first panel, said grasping handle sized and positioned to pass through said handle aperture when said panels are in said closed orientation;

a first wheel and a second wheel, each of said wheels rotatably joined with said container, said wheels spaced apart by substantially the full width of said container;

a telescoping handle construction formed integral with said rear wall, said handle construction selectively positionable in a fully retracted orientation or an extended orientation; and integrated flexible straps cooperating with said telescoping handle construction, each of said straps having a proximal end spaced apart from a distal end by a middle portion extending therebetween, each said distal end including a hook shaped to selectively engage said handle construction, each of said proximal ends attached to a strap positioning means constructed and arranged to provide slack-free adjustment of the effective length of said straps;

whereby said telescoping handle construction cooperates with said wheels to allow rolling transportation of said container when said telescoping handle construction is in said extended orientation and said container is in a tilted position, and retracts to allow unrestricted opening and closing of said hingedly secured panels of said lid.

2. The wheeled briefcase according to claim 1 wherein said front wall includes a strap guide shaped to direct said flexible straps into a preselected orientation.

3. The wheeled briefcase according to claim 1 wherein said telescoping handle construction includes: a plurality of telescoping rods, each of said rods having a first end and an opposite second end, each of said first ends joined to said container rear wall;

a control bar extending between each of said rod second ends; and a releasable locking mechanism that selectively maintains said rods in a predetermined orientation.

4. The wheeled briefcase according to claim 1 wherein said wheels are substantially recessed within said container, said wheels being positioned to allow rolling transportation of said briefcase when said container is in a tilted orientation.

5. The wheeled briefcase according to claim 1 constructed and arranged to accommodate the placement of a similarly sized and shaped briefcase upon said lid when said hingedly secured panels are folded into a closed orientation.

* * * * *